US010677571B2

(12) United States Patent
Oh et al.

(10) Patent No.: US 10,677,571 B2
(45) Date of Patent: Jun. 9, 2020

(54) ELECTRONIC DART MACHINE

(71) Applicant: MOTEGA INNOVATIVE, INC., Anyang-si (KR)

(72) Inventors: Jungwan Oh, Seongnam-si (KR); Jaehyun Choi, Irvine, CA (US); Seungyeon Lee, Seoul (KR); Ohchul Kwon, Redondo Beach, CA (US); Gihwan Han, Paju-si (KR)

(73) Assignee: MOTEGA INNOVATIVE, INC., Anyang-si (KR)

( * ) Notice: Subject to any disclaimer, the term of this patent is extended or adjusted under 35 U.S.C. 154(b) by 187 days.

(21) Appl. No.: 15/753,390

(22) PCT Filed: Aug. 11, 2016

(86) PCT No.: PCT/KR2016/008861

§ 371 (c)(1),
(2) Date: Feb. 19, 2018

(87) PCT Pub. No.: WO2017/034193

PCT Pub. Date: Mar. 2, 2017

(65) Prior Publication Data

US 2018/0238662 A1 Aug. 23, 2018

(30) Foreign Application Priority Data

Aug. 21, 2015 (KR) ..... 10-2015-0117907
Feb. 22, 2016 (KR) ..... 10-2016-0020798

(51) Int. Cl.
*F41J 5/14* (2006.01)
*F41J 5/24* (2006.01)
(Continued)

(52) U.S. Cl.
CPC ..... *F41J 5/14* (2013.01); *A63F 9/0208* (2013.01); *F41J 3/00* (2013.01); *F41J 3/0066* (2013.01);
(Continued)

(58) Field of Classification Search
CPC ..... F41J 5/14; F41J 5/24; F41J 5/04; F41J 5/052; F41J 3/02; F41J 3/00; F41J 3/0066; A63F 9/0208; A63F 2009/0221
See application file for complete search history.

(56) References Cited

U.S. PATENT DOCUMENTS 4,333,657 A * 6/1982 Jaworski ..... F41J 5/04 273/368
8,740,222 B1 6/2014 Krzewicki
2012/0248702 A1* 10/2012 Kim ..... F41J 3/00 273/348.3

FOREIGN PATENT DOCUMENTS

CN 201974106 9/2011
JP 3084716 3/2002
(Continued)

OTHER PUBLICATIONS

EPO. Extended Search Report of EP 16839482.3 dated Mar. 8, 2019.
KIPO, Notice of Preliminary Rejection of KR 10-2015-0117907 dated Oct. 13, 2015.
KIPO, Notice of Preliminary Rejection of KR 10-2016-0020798 dated Oct. 16, 2017.
WIPO, International Search Report of PCT/KR2016/008861 dated Nov. 21, 2016.
(Continued)

*Primary Examiner* — Kevin Y Kim
(74) *Attorney, Agent, or Firm* — Lex IP Meister, PLLC

(57) ABSTRACT

The present invention relates to an electronic dart machine for displaying a point of a corresponding part in an area hit by a dart, using an LED. The present invention provides an electronic dart machine including: a dart target part, which has the shape of a board having multiple divided target areas and includes a sensor means for detecting the location of a target area hit by a dart; an LED display part positioned at a location corresponding to each target area along the
(Continued)

periphery of the dart target part; and a controller for controlling an output display of each LED module by preset control logic, recognizing the location of the target area hit by the dart, through the sensor means, and producing a dart hitting result by linking a content of the output display of the LED module with the location of the target area hit by the dart.

16 Claims, 17 Drawing Sheets

(51) Int. Cl.

| | |
|---|---|
| ***F41J 3/02*** | (2006.01) |
| ***F41J 5/04*** | (2006.01) |
| ***F41J 3/00*** | (2006.01) |
| ***A63F 9/02*** | (2006.01) |
| ***F41J 5/052*** | (2006.01) |

(52) U.S. Cl.
CPC . *F41J 3/02* (2013.01); *F41J 5/04* (2013.01); *F41J 5/24* (2013.01); *A63F 2009/0221* (2013.01); *F41J 5/052* (2013.01)

(56) References Cited

FOREIGN PATENT DOCUMENTS

| | | |
|---|---|---|
| JP | 2006-280527 | 10/2006 |
| JP | 2008-061755 | 3/2008 |
| KR | 10-2004-0078981 | 9/2004 |
| KR | 10-1142136 | 4/2012 |
| KR | 10-1142136 | 5/2012 |
| KR | 10-2015-0093376 | 8/2015 |

OTHER PUBLICATIONS

TIPO, Notice of Preliminary Rejection of TW 105124967 dated Jun. 30, 2017.
SIPO, A Notification of the First Office Action of CN 201680007994.7 dated May 18, 2018.
SIPO, A Notification of the Second Office Action of CN 201680007994.7 dated Feb. 1, 2019.
JPO, A Notification of Reasons for Refusal of JP 2018-528923 dated Jan. 8, 2019.

* cited by examiner (a)

(b)

(c)

ELECTRONIC DART MACHINE

TECHNICAL FIELD

The present invention relates to an electronic dart machine. More particularly, the present invention relates to an electronic dart machine configured to produce points by automatically recognizing a part being hit by a dart and to allow that a performance of various events and various expressions according to events are possible, by allowing a point of a part corresponding to an area hit by a dart to be displayed, using an LED, provided that the point is variably displayed by an electronic control scheme.

BACKGROUND ART

Darts is an indoor sport of hitting a dartboard with a small arrow-shaped dart and acquiring a point corresponding to a part hit by the dart.

A dartboard is marked with numbers, for example, number 20 at a top side of the central part of the dartboard and numbers 1, 18, 4, 13, 6, 10, 15, 2, 17, 3, 19, 7, 16, 8,14, 11, 9, 12, and 5 arranged from number 20 in a clockwise direction around the board. Each of these numbers corresponds to points to be acquired when the dart is stuck into a general area, wherein the general area has a relatively large portion of a point area block corresponding to a specific number displayed on the dartboard. For a relatively small area formed as a band at an outermost periphery side of the general area, points are produced by multiplying two to the number for the general area, and for another smaller area formed as a band at a side closer to a central part, points are produced by multiplying three to the number for the general area. A circle at a central part is divided into two concentric circles, and point 50 is designated to each part, or point 50 for an innermost part and point 25 for a periphery part are designated.

In a game using a dart, generally one person produces a point for one round by throwing the dart three times and produces total hitting result by trying five to fifteen rounds per person or more according to game setting. Accordingly, a person who acquires higher points or a preset point earlier wins the game.

In a game using a conventional dart, arguments may occur between users because it may be difficult to identify an exact location of a part that the dart is stuck into.

To improve this, much research has been conducted to automatically recognize a location that a dart tip is stuck into. For example, Korea Patent No. KR 10-1032402 relates to a technology to identify an exact location that a dart tip is stuck into by displaying the area hit by the dart by a light emitted from an LED positioned at the area.

However, for the conventional art, there is an impression that a dart game is difficult for a beginner to play, because a point corresponding to a specific area of a dart is fixed, and it is not configured at all to take into consideration of difference in skill levels between a person who throws a dart well and a person who does not. Accordingly, there exists a problem that the dart game is difficult to be popularized as a sport.

DISCLOSURE

Technical Problem

According to the present invention, an electronic dart machine calculating points by automatically recognizing a part hit by a dart, has been developed by taking the problems above into consideration and an objective thereof is to provide an electronic dart machine allowing that a performance of various kinds of events and various expressions according to an event are possible by allowing a point of a part corresponding to an area hit by a dart to be displayed using an LED, provided that the point is variably displayed by an electronic control scheme.

Technical Solution

An aspect of the present invention to accomplish the above object provides an electronic dart machine, including: a dart target part having a board shape divided into a plurality of target areas and including a sensor means detecting a location of a target area hit by a dart; an LED display part including a plurality of LED modules, each LED module being positioned at a location corresponding to an outermost part of each target area along a periphery of the dart target part; and a controller controlling an output display of each LED module by a preset control logic, recognizing the location of a target area through the sensor means, the location being hit by the dart, and producing a dart hitting result by linking a content of the output display of the LED module with the location of the target area to the location being hit by the dart.

Preferably, the dart target part has a circular-shaped front surface part, and the LED display part has a ring-shaped front surface part a surrounding the periphery of the dart target part.

Preferably, the LED display part includes a display board formed in a ring shape with the LED modules being attached thereto; and a cover board formed in a ring shape corresponding to the shape of the display board, installed in a front surface side of the display board, having protection windows each formed at a location corresponding to each LED module, and having a plurality of tip holes at an area other than the protection windows so as to allow a dart tip to be inserted thereinto.

Preferably, at outermost locations of the LED modules of the display board, a plurality of lighting LEDs are positioned in a ring shape, and, on a dartboard front surface frame having a front surface part surrounding the periphery of the cover board, a light projection part that allows light projected from the lighting LEDs to pass through is provided.

Preferably, the electronic dart machine further includes display means displaying the dart hitting result produced by the controller; and input means inputting at least one of a game start command, user identification information, and an event request command.

Preferably, the output display of each LED module is a number display corresponding to each target area and variably displayed by the preset control logic.

Preferably, the output display of each LED module is a display for an event generated by the preset control logic.

Preferably, the preset control logic is set such that the display for the event to be generated on the basis of any one of preset cumulative number of times of the dart hitting, randomly generated cumulative number of times of the dart hitting, passing of a preset elapse time or not, passing of a randomly generated elapse time or not, user identification information, and an event request command.

Preferably, depending on a success or a failure of meeting an event condition on the basis of the display for the event, the output display of each LED module in subsequent order is controlled to be variable.

Preferably, the event condition is a success or a failure of a dart hitting a specific target area and on the basis of a success or a failure of meeting the event condition, a number, displayed on each LED module in a subsequent order, corresponding to each target area is controlled to become larger or smaller.

Preferably, the electronic dart machine further includes display means displaying the dart hitting result produced by the controller; and input means inputting a control command, wherein the output display of each LED module is a number display corresponding to each target area and variably displayed as time goes by within a one turn by a preset control logic.

Preferably, the output display of each LED module is controlled such that locations of the numbers of the LED modules are to be changed in a rotation direction as time passes.

Preferably, the output display of each LED module is controlled such that locations of the numbers of the LED modules are to be changed randomly as time passes.

Preferably, the output display of each LED module is controlled such that a change speed of locations of the numbers of the LED modules is gradually decreased from a point of time of the dart hitting, and variable display of the locations of the numbers is stopped as time goes by.

Preferably, the output display of each LED module is controlled such that, at a point of time when preset time interval to stop has passed from a point of time of the dart hitting, variable display of locations of the numbers of the LED modules depending on a passage of time is stopped.

Preferably, the dart hitting result is produced as the content of the output display of an LED module corresponding to the location of the target area hit by the dart at a point of time when variable display of locations of the numbers of the LED modules is stopped.

Preferably, the dart hitting result is produced as the content of the output display of an LED module corresponding to the location of the target area hit by the dart at a point of time of the dart hitting.

Preferably, the output display of each LED module is a display for an event generated by the preset control logic, the preset control logic is set such that the display for the event is produced on the basis of any one of preset cumulative number of times of the dart hitting, randomly generated cumulative number of times of the dart hitting, passing of preset elapse time or not, passing of randomly generated elapse time or not, user identification information, and an event request command, and depending on a success or a failure of the event condition on the basis of the display for the event, at least one of a display of an end of the event and a guide display of an event provision in a next turn is provided in the display means.

Advantageous Effects

The present invention controls an output display of each LED module by a preset control logic, enables fast and accurate confirmation of a point by exactly recognizing a location of a target area hit by a dart through a sensor means. Accordingly, the present invention has an advantage to provide unpredictability not proportional to a level of dart skill of a player, provided that a location of a number is variably displayed.

In addition, the present invention may compensate a drawback that a user is likely to give up playing a dart game due to a difference of skill level, and have an advantage of contributing to making darts a popular sport by allowing a new user to more easily access the dart game.

Particularly, the present invention provides an environment in which various kinds of dart games and events may be developed by allowing a location of a number to be variably displayed in various ways. Meanwhile the present invention has an advantage of stimulating desire to play by providing variability to a level of difficulty for achieving an event condition.

In addition, the present invention has an advantage of preventing a problem occurring from a dart deviating a dartboard and hitting an area within a certain range, dropping on the floor or rebounding from a target by allowing a dart tip to be inserted even into a periphery area of the LED display part.

In addition, the present invention has an advantage of being able to provide lighting corresponding to various events at an LED display part and/or outskirt side of a dartboard.

In addition, the present invention has an advantage that displays corresponding to various events may be provided by allowing letters, marks, etc. besides the numbers to be displayed on the LED display part.

MODE FOR INVENTION

The present invention may be implemented in various forms without departing from the technical spirit and principal features thereof. Accordingly, the exemplary embodiments of the present invention are merely examples at all points and should not be understood to limit the scope of the present invention.

Terms such as "the first" and "the second" are used for a purpose only to distinguish one constituent from another constituent. For example, not deviating from a protection scope according to the concept of the present invention, the first constituent may be named as the second constituent or, similarly, the second constituent may be named as the first constituent.

When a constituent is referred to as being "connected" or "joined" to another constituent, this should be understood that the constituent may be directly connected or joined to the other constituent, but a different constituent may be interposed therebetween.

An expression in a singular form used in the present invention includes an expression in a plural form, unless the meaning is obviously different contextually. It should be understood that terms such as "include", "equip", or "have" in the present invention are intended to designate the existence of constituents described in the specification or a combination of these, and not to exclude at least one of other constituents or characteristics, or an additional possibility.

In describing the present invention, detailed descriptions of prior arts which have been deemed to obfuscate the gist of the present invention will be omitted below.

Hereinafter, exemplary embodiments of the present invention will be described in detail with reference to the accompanying drawings.

Figure 1:
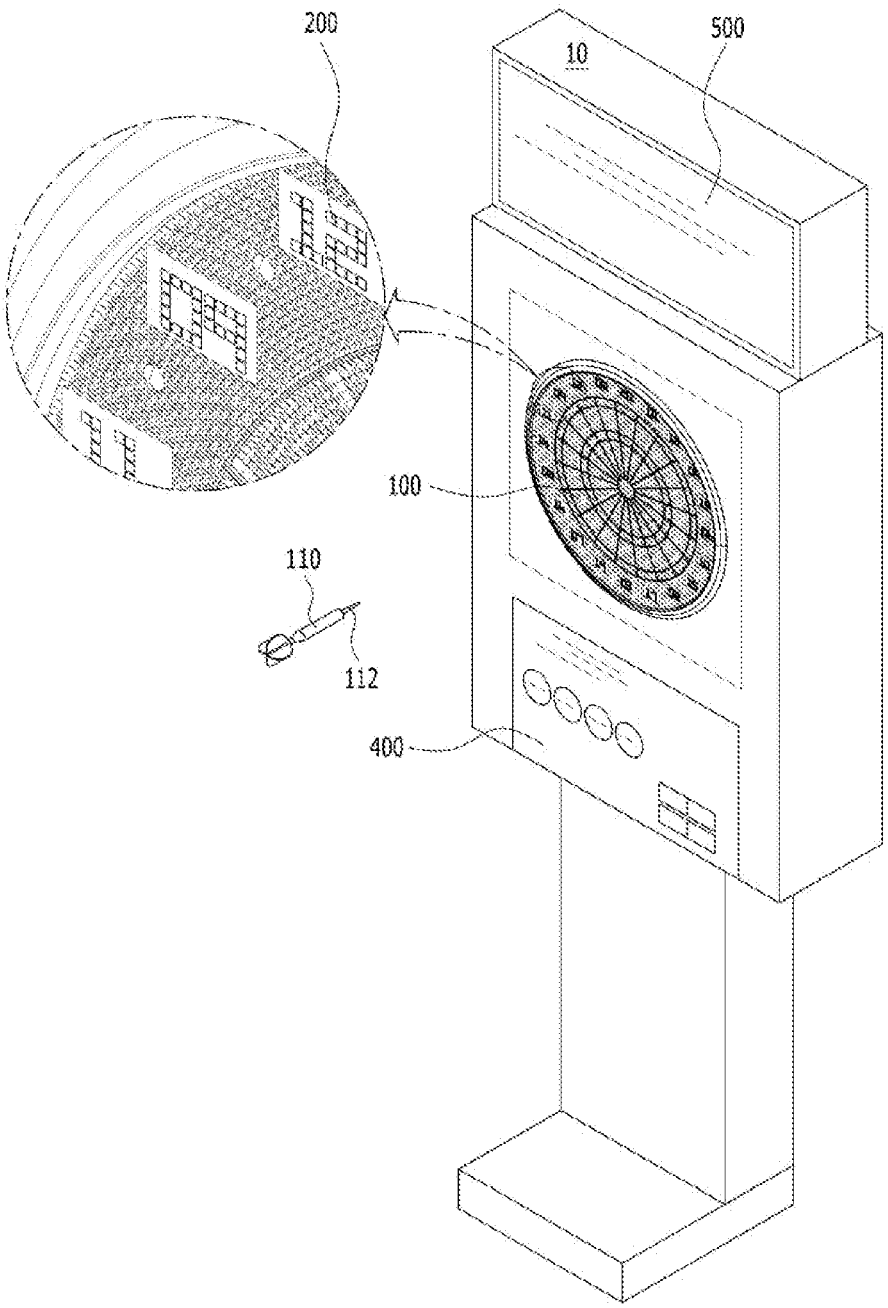
FIG. 1 is a perspective view of an electronic dart machine according to an embodiment of the present invention.
Figure 2:
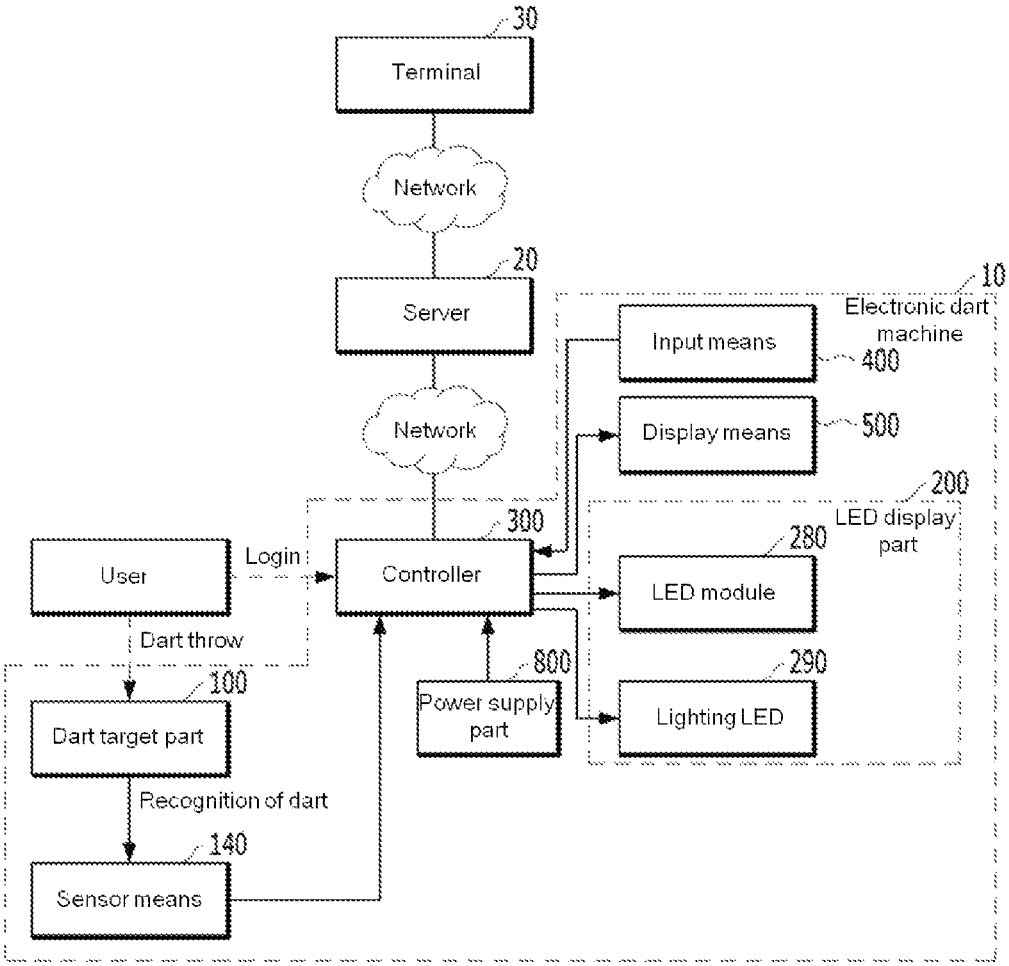
FIG. 2 is a control block diagram for an electronic dart machine according to an embodiment of the present invention.

FIG. 1 is a perspective view of an electronic dart machine according to an embodiment of the present invention, and FIG. 2 is a control block diagram for an electronic dart machine according to an embodiment of the present invention.

Figure 3:
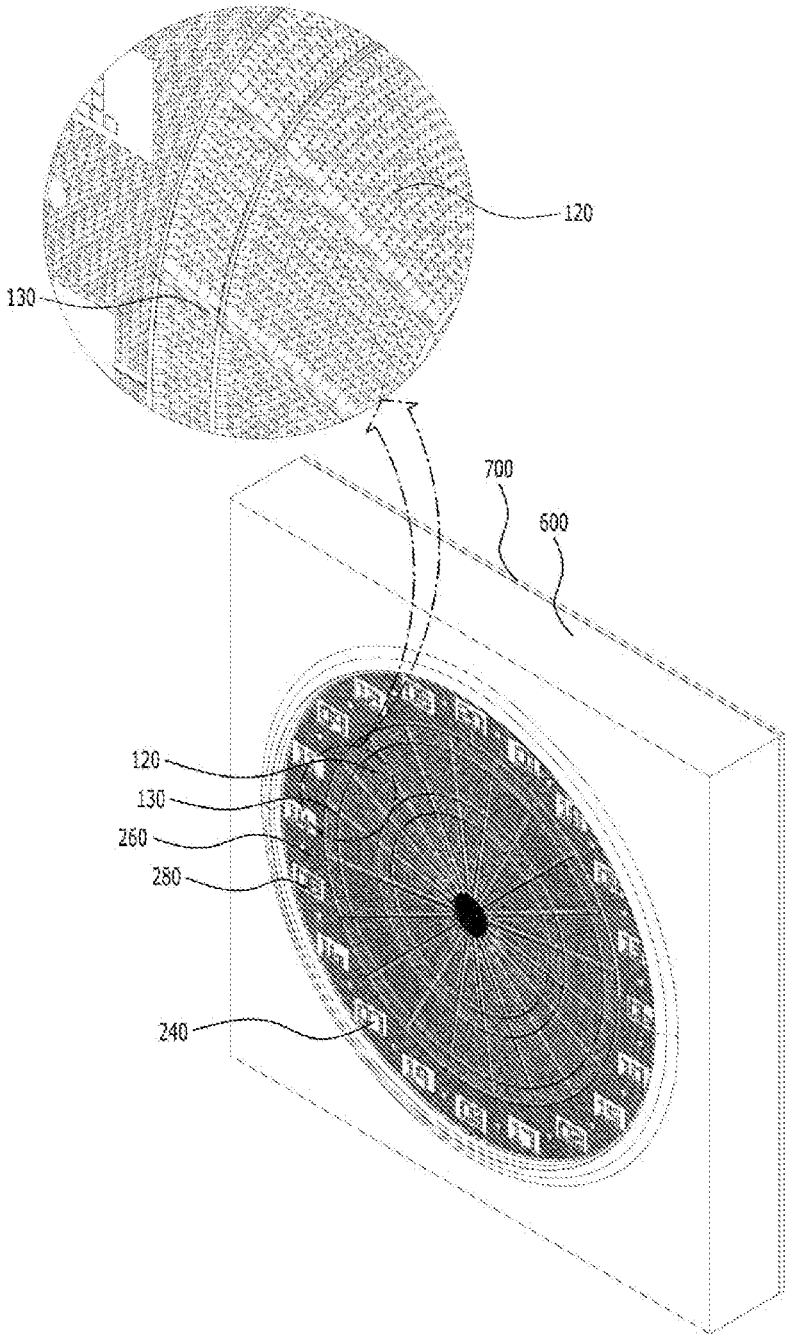
FIG. 3 is a perspective view of a dartboard including a dart target part according to an embodiment of the present invention.
Figure 4:
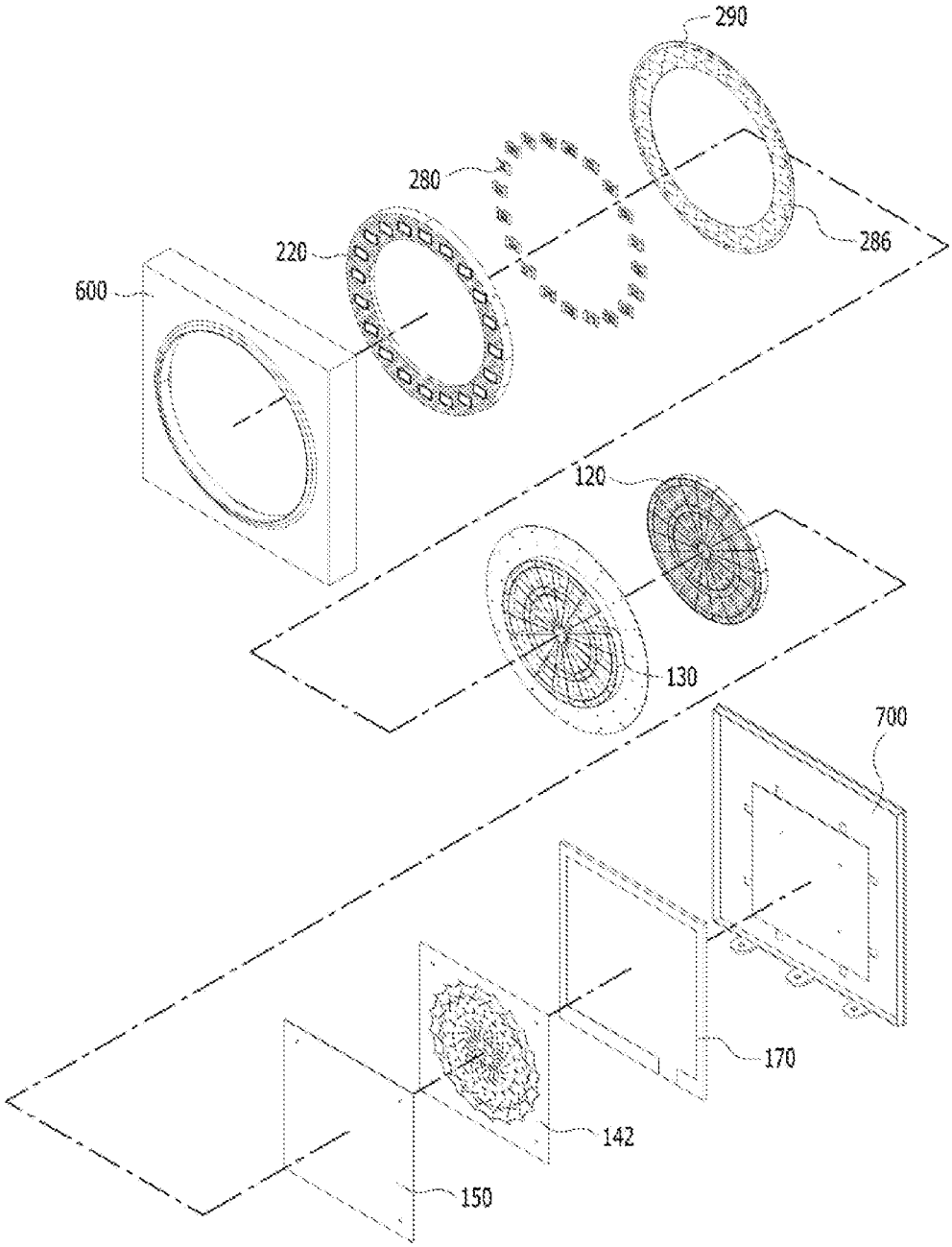
FIG. 4 is an exploded perspective view of a dartboard according to an embodiment of the present invention.
Figure 5:
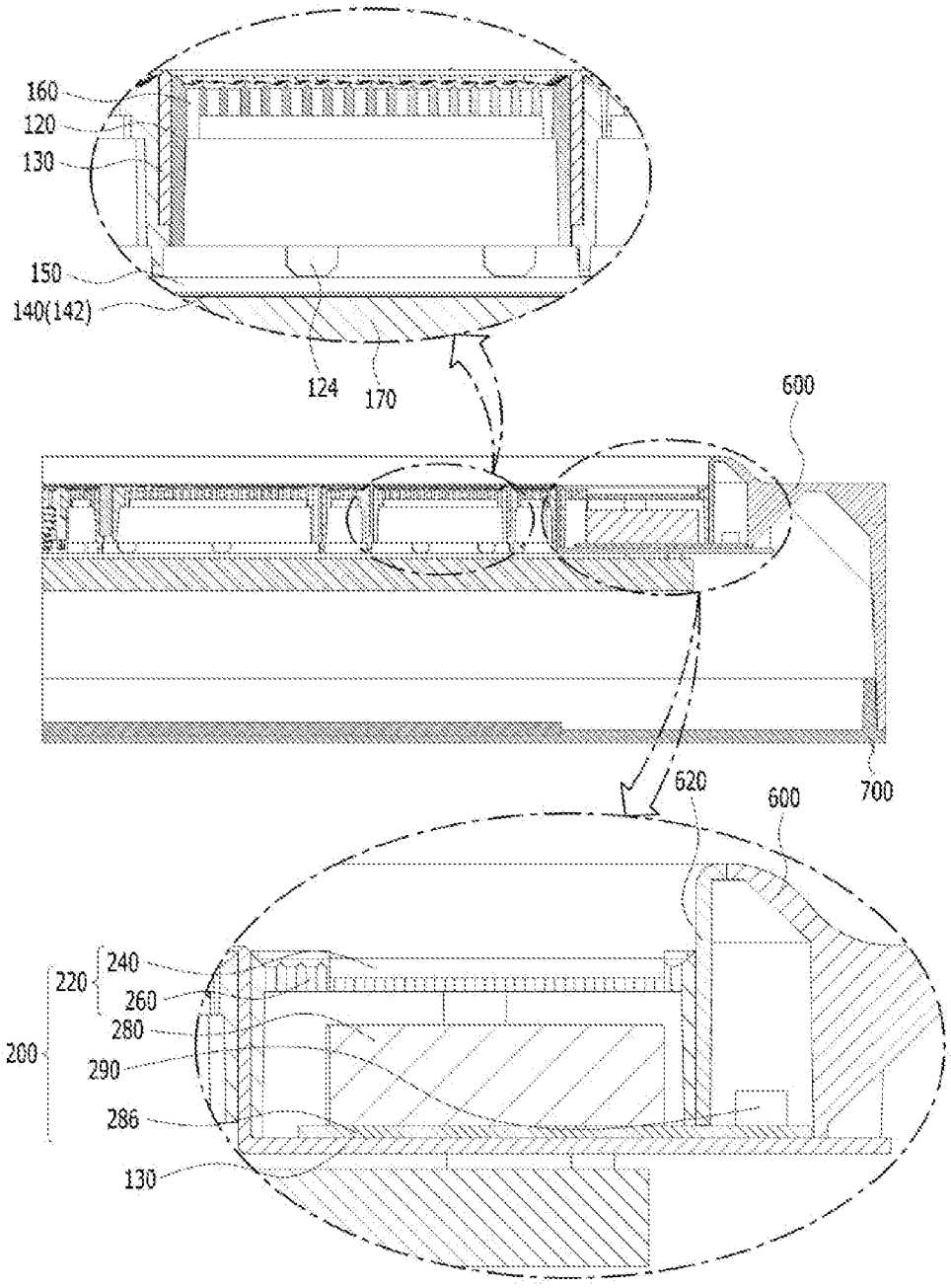
FIG. 5 is a partial cross-sectional view of a dartboard according to an embodiment of the present invention.

FIG. 3 is a perspective view of a dartboard including a dart target part 100 according to an embodiment of the present invention, FIG. 4 is an exploded perspective view of a dartboard according to an embodiment of the present invention, and FIG. 5 is a partial cross-sectional view of a dartboard according to an embodiment of the present invention.

An electronic dart machine 10 according to an embodiment of the present invention is configured to include the dart target part 100, an LED display part 200, and a controller 300. The controller 300 controls the LED display part 200 to display a point corresponding to an area hit by a dart. When the dart 110 hits the dart target part 100, the controller 300 recognizes automatically this and produces a hitting result (e.g., a point).

A dartboard (reference numeral not shown) configured to include the dart target part 100 and the LED display part 200 may be configured to further include, as one example, the controller 300 on the inside thereof. Alternatively, as another example, without including the controller 300 on the inside thereof, the dartboard may be configured to be connected to the controller 300 provided on the outside thereof.

The dart target part 100 has a board shape divided into a plurality of target areas and, may be built to have a circular-shaped front surface part.

The plurality of target areas may be formed with a plurality of point area blocks 120.

To be more particular, the plurality of target areas may be made to include: a general area having a relatively large area and providing a point represented by a specific number displayed on a outskirt side of a hitting area of the dartboard when the dart 110 hits; a double-score area providing a point represented by the specific number multiplied by 2 and having a relatively small area formed as a band at an outermost periphery side of the general area; and a triple-score area providing a point represented by the specific number multiplied by 3 and having an area formed as a band that is smaller and closer to a central part than the double-score area. Meanwhile, each of the general area, the double-score area and the triple-score area may be formed with the point area blocks 120 configured to be fit with a size and a shape thereof.

Each of the point area blocks 120 may be inserted into a dart target frame 130, and, without being fixed to the dart target frame 130, movement thereof may be allowed a little in directions of the front and the back.

The point area blocks 120 may be equipped on one end of the rear surface thereof with a pressurizing part 124 to allow pressure to be imposed on sensor means that will be described later.

The target area of the dart target part 100 may be formed with a plurality of tip holes 160 that a dart tip 112 formed at one end of the dart 110 can be inserted into. The tip holes 160 may hold the dart 110 inserted by force from a throw of a user. The tip holes 160, for example, to facilitate the insertion of the dart tip 112, may be formed to have a shape enlarged a little where the dart tip 112 starts to be inserted; and, to maintain the dart tip 112 to be held well after insertion, to have a shape that a circular type hole having a similar diameter to a diameter of the dart tip 112 is extended.

The dart target part 100 according to an embodiment of the present invention is configured to include a sensor means 140 detecting a location of the target area hit by the dart 110.

The sensor means 140, when the dart 110 hits a front surface of the dart target part 100, detects which part of the point area blocks 120 corresponds to a location of the target area being hit, by a pressure produced in a specific one of the point area blocks 120 of the target area being hit.

The sensor means 140 may use a publicly known membrane board having a plurality of sensor contacts. For example, as the pressurizing part 124, formed on one end of the rear side of the point area blocks 120 of the target area being hit by the dart 110, pressurizes the sensor contacts (reference numeral not shown) of a membrane board 142 formed on a rear surface side of the pressurizing part 124, and then the sensor contact (reference numeral not shown) comes into contact with another sensor contact (reference numeral not shown) having a small gap therebetween, thereby transmitting an electrical pressurization signal to the controller 300, the location of a hitting area can be detected.

The membrane board 142, as one example, may be made to block a short circuit prior to pressurization through a spacer (not shown) separating layers of a two-layer membrane board 142 from each other with a preset distance, and, as another example, may be made to block a short circuit prior to pressurization by establishing only a part of the sensor contact (reference numeral not shown) is exposed in the two-layer membrane board 142 coated with an insulation layer.

Since hitting detection of each hitting area using the membrane board 142 may be understood through a plurality of publicly known technologies including the U.S. Pat. No. 4,561,660 or Korea Patent No. KR 10-1150751, detailed description is omitted here.

On the rear surface of the membrane board 142, a rear surface cover 170 receiving a film-type connection wire (not shown) allowing circuit wire (reference numeral not shown)

formed on the membrane board 142 to be connected to the controller 300 and protecting the membrane board 142 may be formed.

Between the pressurizing part 124 and the membrane board 142, an elastic board 150 allowing the membrane board 142 not to be damaged by the pressurizing part 124 and, after pressurization is accomplished, imposing elasticity for the point area blocks 120 to return back to the original location, that is, the state at a time prior to insertion of the dart 110 may be provided.

Figure 6:
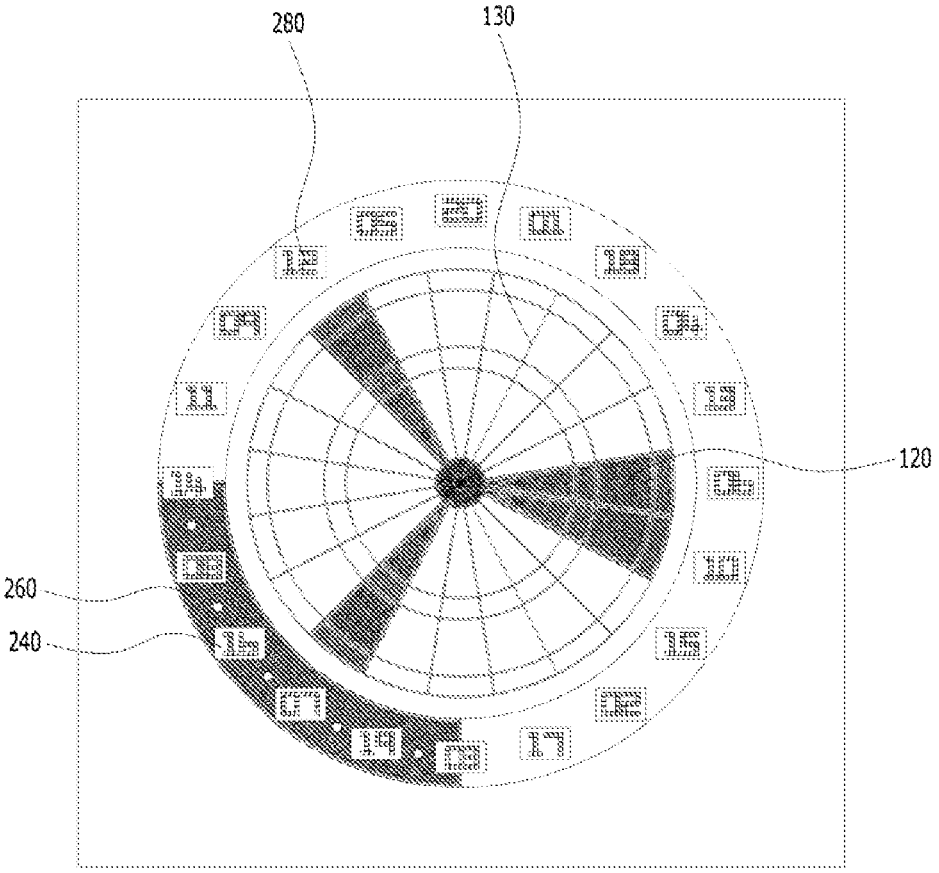
FIG. 6 is a front view of a dartboard according to an embodiment of the present invention.
Figure 7:
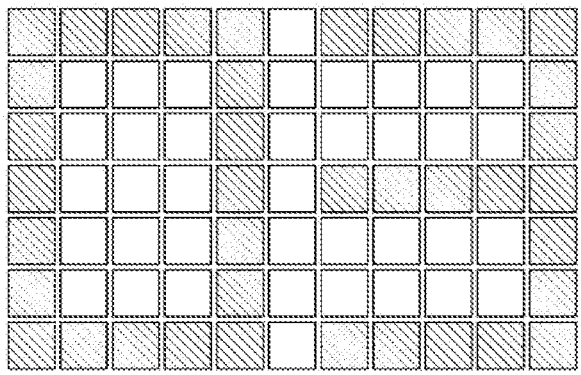
FIG. 7 is an exemplary view displaying an output of an LED module according to an embodiment of the present invention.
Figure 7:
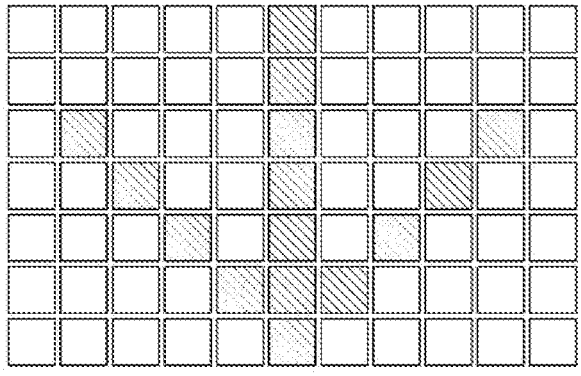
Figure 7:
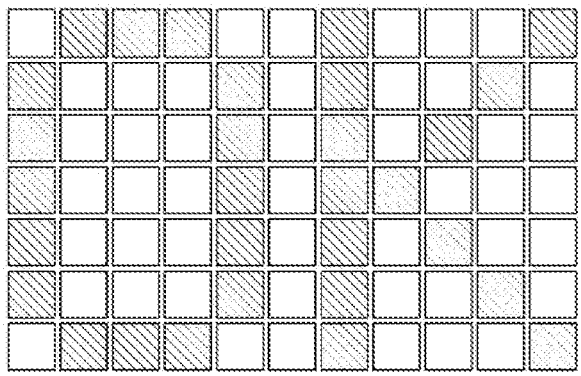

FIG. 6 is a front view of a dartboard according to an embodiment of the present invention, and FIG. 7 is an exemplary view displaying an output of LED modules according to an embodiment of the present invention. The front view of FIG. 6 is a state illustrating that only a few parts of the point area blocks 120 in the actual dartboard are installed within the dart target frames 130 for the sake of convenience, but an actual dartboard has the point area blocks 120 being installed within the dart target frames all over the surface thereof as shown in FIG. 3.

An LED display part 200 is configured to include LED module 280, each LED positioned at a location corresponding to an outermost part of each target area along the periphery of the dart target part 100.

The LED display part 200 may be configured to have a ring-shaped front surface part surrounding the periphery of the dart target part 100.

The LED display part 200 may be able to display a reference point of each target area, and enable each of 20, 1, 18, 4, 13, 6, 10, 15, 2, 17, 3, 19, 7, 16, 8, 14, 11, 9, 12, and 5 to be displayed clockwise from a top side of the central part like a general dartboard, as illustrated in FIG. 6, for example.

For example, each LED module 280 is configured in a form that a plurality of LED chips (reference numeral not shown) are mounted in a grid-type on a one LED board, and the LED display part 200 may be configured to include 20 LED modules 280 to display a number at a location corresponding to an outermost part of each target area.

The number of LED modules 280 may be set as any one of numbers from 1 to 19 or any number equal to or greater than 21. In this case, one LED module 280 may display a number at a location corresponding to outermost parts of at least two target areas, or at least two LED modules 280 may display a number at a location corresponding to an outermost part of one target area.

Each LED module 280 may be composed of, for example, 11×7, that is, 77 LEDs, and, as illustrated in FIG. 7, various expressions may be accomplished through letters, marks, etc. besides numbers by the LED modules 280.

The LED module 280 may be composed of, as one example, unicolor LEDs, or, as another example, multicolored LEDs, whereby realization of various color expressions in the LED module 280 incorporating three-color RGB LEDs, i.e., division of area or event presentation through colors, is accomplished. In addition, as an additional example, the LED module 280 may be composed of publicly known FND modules.

The LED module 280 may be set such that various expressions are accomplished by the controller 300, as will be described in detail later.

The LED modules 280 according to the present embodiment may be attached to a display board 286 formed in a ring shape.

On a front surface side of the LED modules 280, a cover board 220, formed in a ring shape corresponding to a shape of the display board 286 and installed in a front surface side of the display board 286, may be formed, wherein the cover board 220 has a plurality of protection windows 240, each formed at a location corresponding to each LED module 280.

The protection windows 240 may be preferably composed of materials that light can penetrate in order for expression such that a number displayed by each LED module 280 can be seen outside and also prevent the LED modules 280 from being damaged by the dart 110, when a dart deviating from the target area hits the LED module 280. For example, the protection windows 240 may be made by synthetic resin.

The cover board 220 may be configured to have a plurality of tip holes 260 at an area other than the protection windows 240 to allow a dart tip 112 to be inserted therethrough and the shape and function of the tip holes 260 are same as described earlier.

The tip holes 260 formed in the cover board 220 correspond to parts that the darts 110 deviated from the target area are inserted. As one example, the LED display part 200 may enable the controller 300 not to recognize the dart tip 112 being inserted by not installing the sensor means 140 on the rear surface side thereof. Alternatively, as another example, the LED display part 200 may allow the sensor means 140 to be installed on the rear surface side thereof, but to be assigned a zero point in the areas of the holes 260.

At the outermost locations of the LED modules 280 of the display board 286, a plurality of lighting LEDs 290 may be positioned in a ring shape. The lighting LEDs 290 may be made by using publicly known RGB LEDs, and used for illumination, by illuminating light into the front surface and/or the side surface from the LED display part 200, for the expression of various situations such as a start of a game, a moment of point-earning, a finalization announcement of a victory or defeat, an end of a game, and so on.

On a dartboard front surface frame 600 having a front surface part surrounding the periphery of the cover board 220, a light projection part 620 wherein light projected from the lighting LEDs 290 passes through may be provided. The light projection part 620 is able to allow light projected from the lighting LEDs 290 to be illuminated into: a side surface part of the LED display part 200, that is, an inward direction of the dartboard; or the front surface part or side surface part of LED module 280 as background lighting type. The light projection part 620 may be made of a material that allows light to penetrate and, for example, synthetic resins. The dartboard front surface frame 600 may be formed by combining the light projection part 620 with a part excluding the light projection part 620 after separately forming the parts, or by injection molding with different materials in one body.

The dartboard configured to include the dart target part 100 and the LED display part 200 may be finally achieved for protecting the LED modules 280 and the sensor means 140 by coupling of the dartboard front surface frame 600 and a dartboard rear surface frame 700.

The controller 300 according to an embodiment of the present invention controls an output display of each LED module 280 by a preset control logic, recognizes the location of the target area hit by the dart 110 through the sensor means 140, and produces a dart hitting result by linking a content of the output display of the LED module 280 to the location of the target area that has been hit by the dart 110.

For example, depending on mutual linking, the controller 300 remembers a number (or an event mark) displayed by an output display control of the LED module 280; receives information on a location of the target area hit by the dart 110 detected through the sensor means 140; and, by using and linking the information on a location of the target area hit by the dart 110, being input, and the information on the number (or the event mark) being remembered, may determine a recording of points depending on dart hitting results and/or a success or a failure of an event.

The controller 300 may be understood as, for example, an embedded computer, a PC or a Micom controller, etc. installed inside the electronic dart machine 10.

In the controller 300, an LED control board (not shown) may be further configured for the lighting control of the LED module 280.

The output display of each LED module 280 controlled by the controller 300, for example, is a number display corresponding to each target area and variably displayed by a preset control logic.

The preset control logic is to control for numbers to be displayed by the LED modules 280. In this connection, the controller 300, as one example, as illustrated in FIG. 6, is able to set an expressed number to be displayed the same as is designated by a general dart rule; or, as another example, as illustrated in FIG. 8 that will be described later herein, to allow a location of a number to be changed or a completely different number to be displayed when an event is generated.

The controller 300 is able to control such that various expressions corresponding to several kinds of events are accomplished by allowing numbers, letters, marks, etc., to be displayed on the LED modules 280 and various effects such as rotation or flicker thereof to be directed. Furthermore, the controller 300 is able to play a role in parallel as an interface adjusting a level of difficulty of an event through the direction.

Figure 8:
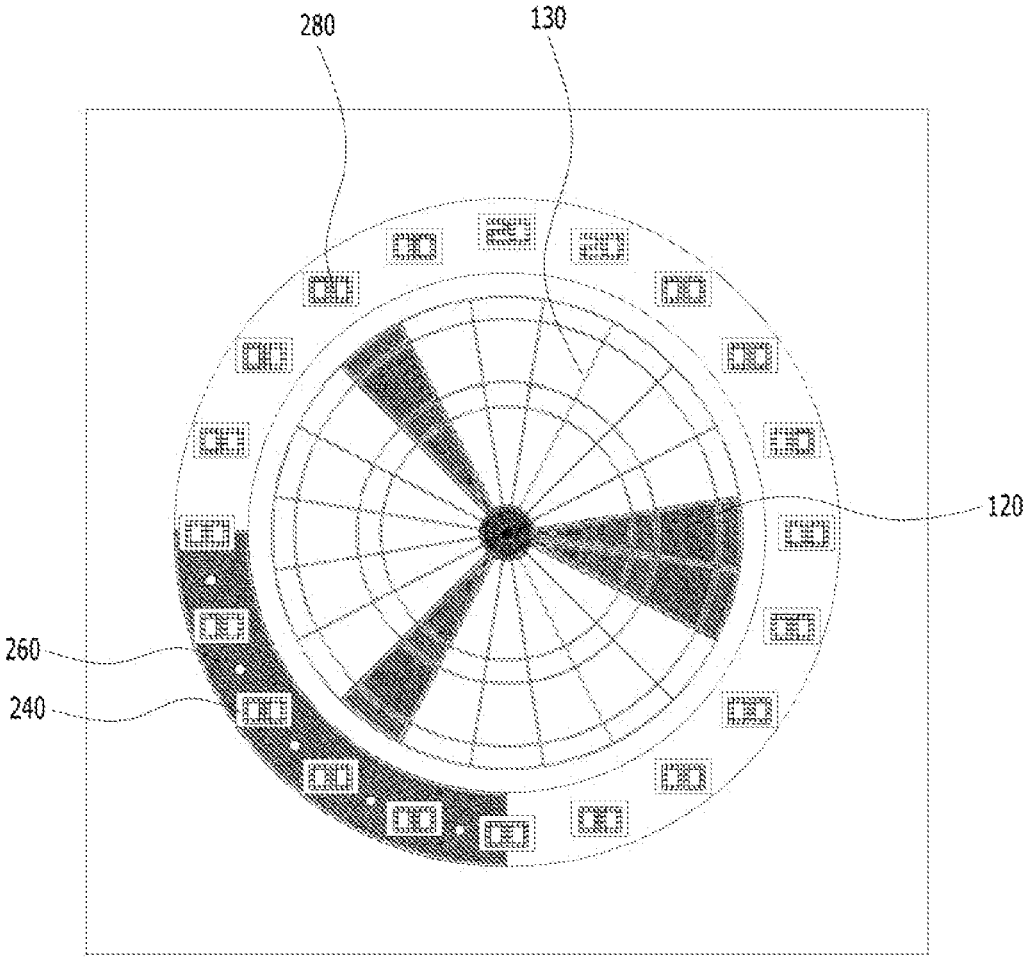
FIG. 8 is a front view of a dartboard in the case of an event generation according to an embodiment of the present invention.

A control of the LED module 280 to adjust the level of difficulty, as illustrated in FIG. 8, may be accomplished by providing a range of advantageous or disadvantageous target areas to a user widely by displaying the same number or the same letter on at least two target areas.

Figure 9:
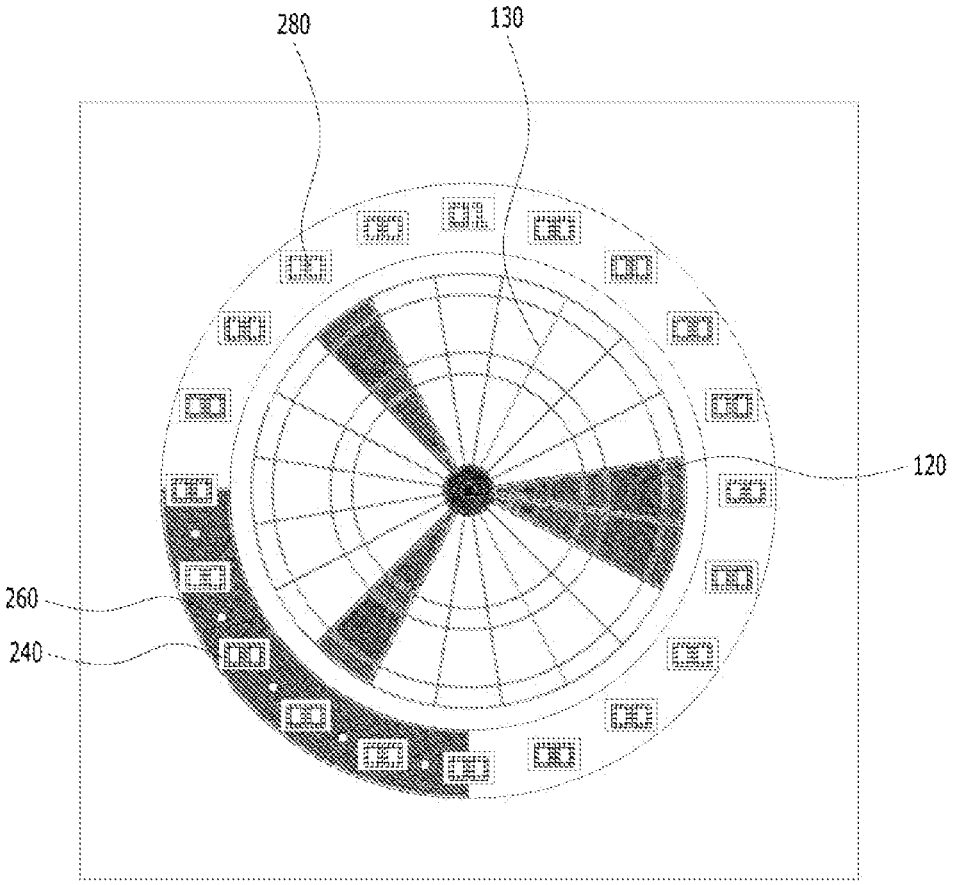
FIGS. 9 and 10 are front views of a dartboard in a next order following an event according to an embodiment of the present invention.
Figure 10:
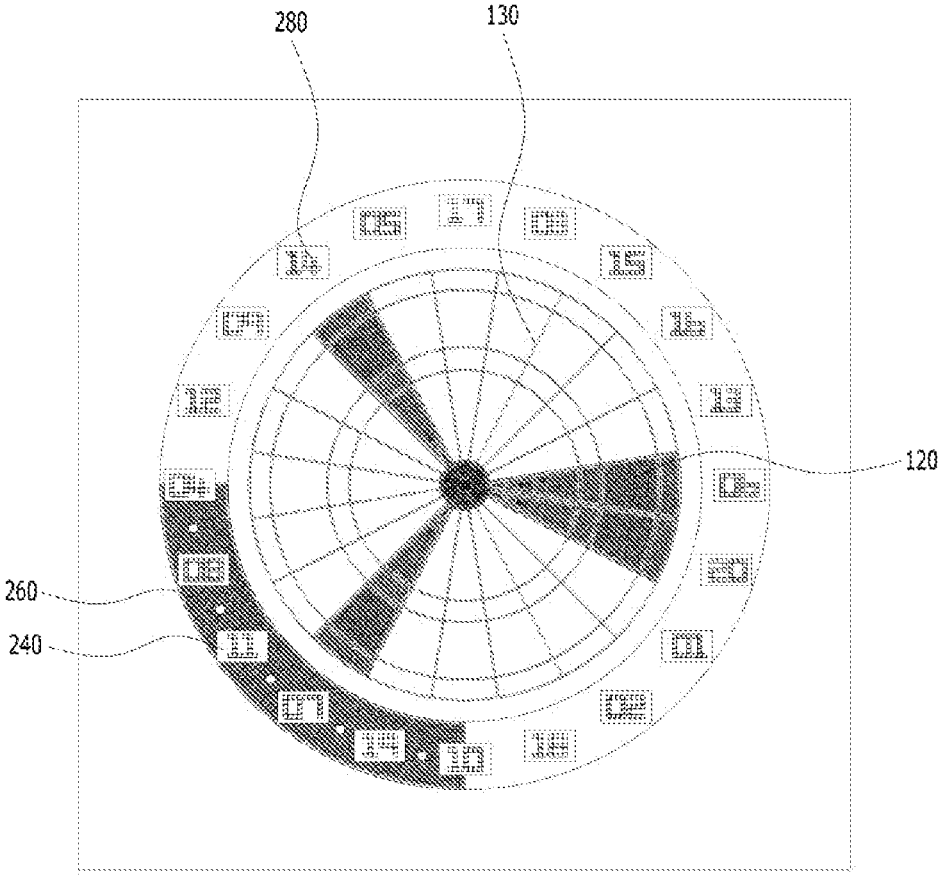

FIG. 8 is a front view of a dartboard in the case of an event generation according to an embodiment of the present invention. In addition, FIGS. 9 and 10 are front views of a dartboard in a next order following an event according to an embodiment of the present invention. As front views of dartboards of FIGS. 8, 9, and 10 illustrate states that some point area blocks 120 and others in an actual dartboard are not shown for the sake of convenience, the actual dartboard may be understood to be configured to have a form as in FIG. 3.

An output display of each LED module 280 by the controller 300, as another example, may be set to be a display for an event generated by the preset control.

The event is produced on the basis of a cumulative number of times of the dart hitting, time elapsed or not, user identification information, and an event request command, and may be used to give a variety to a dart game underway or to compensate a game when skill levels of dart game users are different.

An event, for example, may be configured to be a change of a level of difficulty for acquiring a point, provision of an additional point, or provision of a mobile coupon and/or a giveaway, and since a user identification including user information may be required for the event, a process of input of user information or user log-in through input means to be described later may be preceded.

The control logic may be set such that the display for the event to be produced is on the basis of any one of preset cumulative number of times of the dart hitting, randomly generated cumulative number of times of the dart hitting, passing of preset elapse time or not, passing of randomly generated elapse time or not, user identification information, and an event request command.

The display for the event, for example, as illustrated in FIG. 8, by displaying a specific number to specific target areas, and a number of zero to remaining target areas, may be configured to acknowledge a point only when a target area that a specific number is displayed on is hit.

The display for the event is not limited to a number, and may be composed of a mark such as an arrow, letter and/or combination thereof.

For example, as illustrated in FIG. 7*b*, according to an event generation, the display for the event may be set such that an arrow is displayed on the specific target area to be hit by the dart 110.

Depending on a success or a failure of meeting the event condition on the basis of the display for the event, an output display of each LED module 280 in subsequent order is controlled to be variable. The event condition may be a success or a failure of a dart hitting a specific target area.

For example, when the event condition is met, that is, when a dart hitting on a specific target area is accomplished, as illustrated in FIG. 7*c*, the display for the event may be set such that letters announcing a success of the event are displayed.

On the basis of a success or a failure of meeting the event condition, a number that is to be displayed as an output of each LED module 280 in a subsequent order and is corresponding to each target area may be controlled to increase or decrease.

As one example, in the case that the first user meets the event condition by hitting the dart 110 on a specific target area, when a target hitting in a subsequent order of the first user is attempted, in order to enhance a possibility of getting a point higher than a point obtainable before the event, at least a part of numbers that are to be displayed as the outputs of the LED modules 280 may be set and controlled to be configured with numbers greater than numbers corresponding to the same location before the event.

As another example, in the case that the first user meets the event condition by hitting the dart 110 on a specific target area, when a target hitting of the second user in a subsequent order is attempted, in order to enhance a possibility of getting a lower point than a point obtainable before the event, at least a part of numbers that are to be displayed as the outputs of the LED modules 280 may be set and controlled to be configured with numbers lesser than numbers corresponding to the same location before the event.

As an additional example, in the case that the first user does not meet the event condition without hitting the dart 110 on a specific target area, as illustrated in FIG. 9, when a target hitting in a subsequent order of the first user is attempted, numbers that are to be displayed as the outputs of the LED modules 280 may be set and controlled to be configured with numbers lesser than numbers corresponding to the same location before the event, or, when a target hitting of the second user in a subsequent order is attempted, numbers that are to be displayed as the outputs of the LED modules 280 may be set and controlled to be configured with numbers greater than numbers corresponding to the same location before the event.

As an additional example, in the case that the first user does not meet the event condition without hitting the dart 110 on a specific target area, as illustrated in FIG. 10, when a target hitting in a subsequent order of the first user is attempted, an order and location of numbers that are to be displayed as the output of the LED modules 280 may be set and controlled to be changed.

As another additional example for the output display of each LED module 280 in a next order according to a process of an event, along with a success or a failure of meeting the event condition, the control may be accomplished on a basis of acquired points of a user.

That is, in the case that a game ends only when summed points are equal to specific points, appropriate setting for numbers that are to be displayed as the output of the LED modules 280 not only to win many points but also to win desired points easily may be a set advantageous to a user who achieved the event condition.

In this case, in connection with a success or a failure of meeting the event condition, it is necessary to be set not only for numbers displaying the output of the LED modules 280 to become larger or smaller but also for a user to be advantageous or disadvantageous in winning remaining points required for the user to end a game, on the basis of points the user has acquired.

Accordingly, along with a success or a failure of meeting the event condition, control of the output display of each LED module 280 in a subsequent order on the basis of acquired points by the user may be preferable to be controlled to approach closer to or go away further from, so called, 'game ending condition' enabling a game to be culminated in victory.

Figure 11:
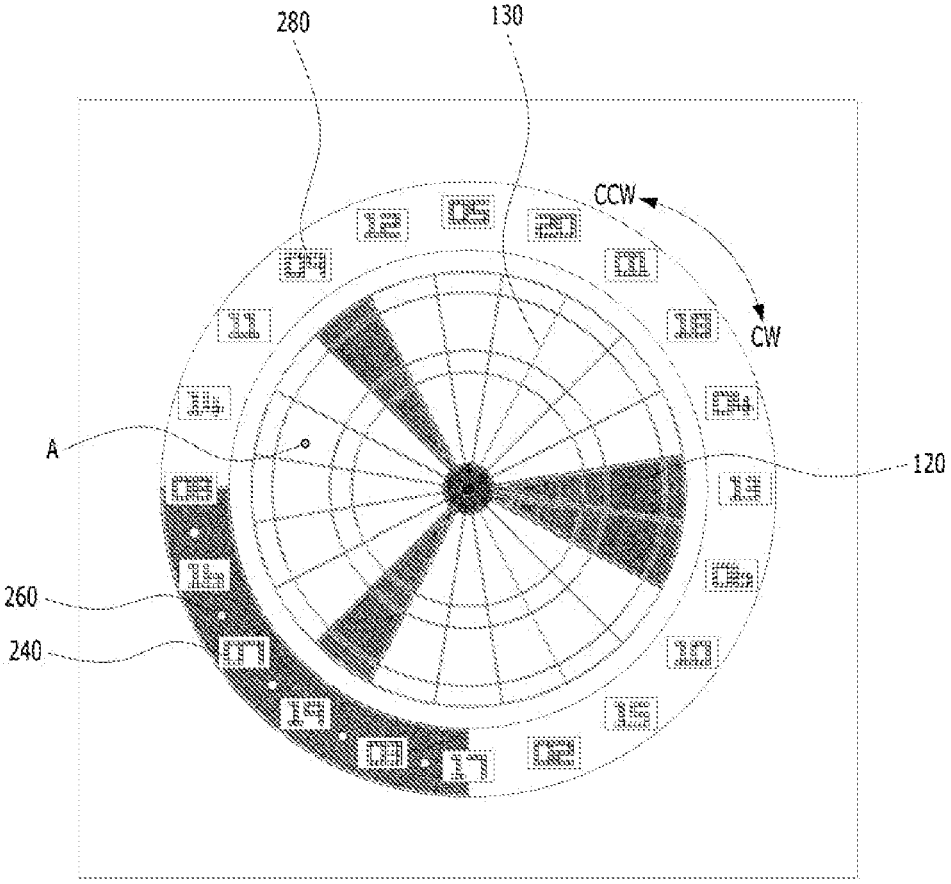
FIGS. 11 to 12 are exemplary views showing that display locations of numbers variably change as time passes within a one turn of an output of LED modules according to an embodiment of the present invention.
Figure 12:
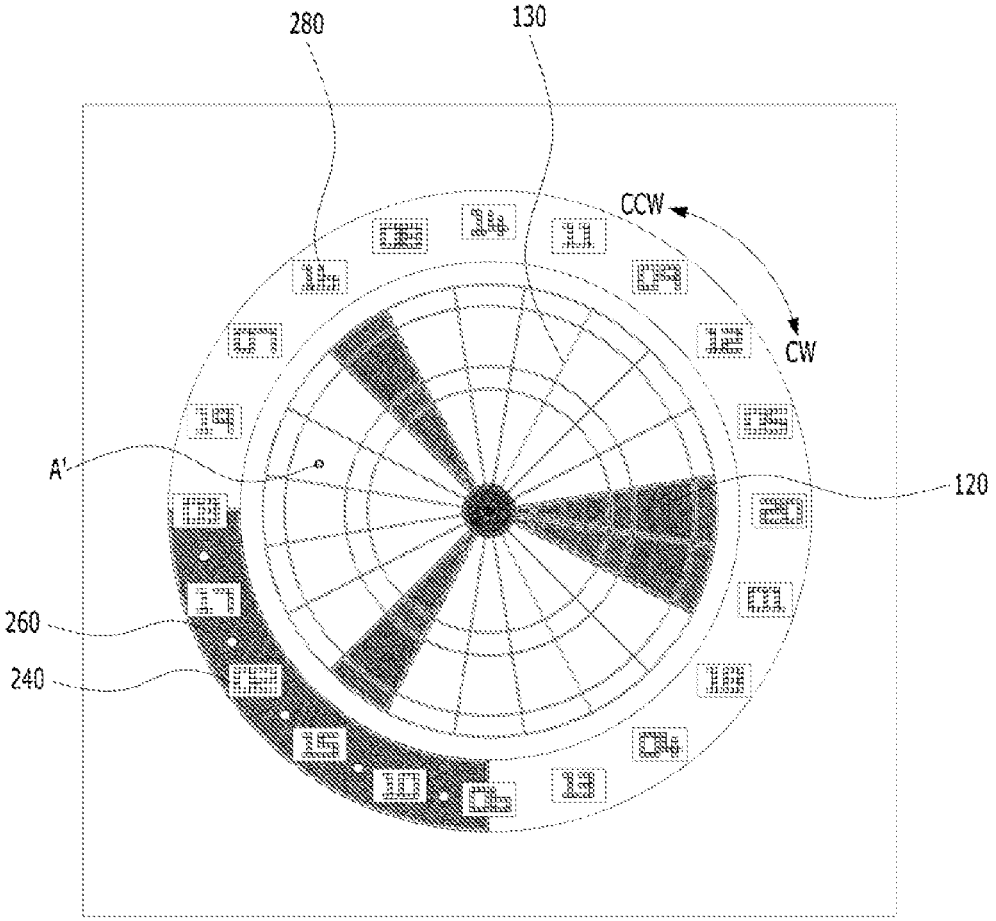
Figure 13:
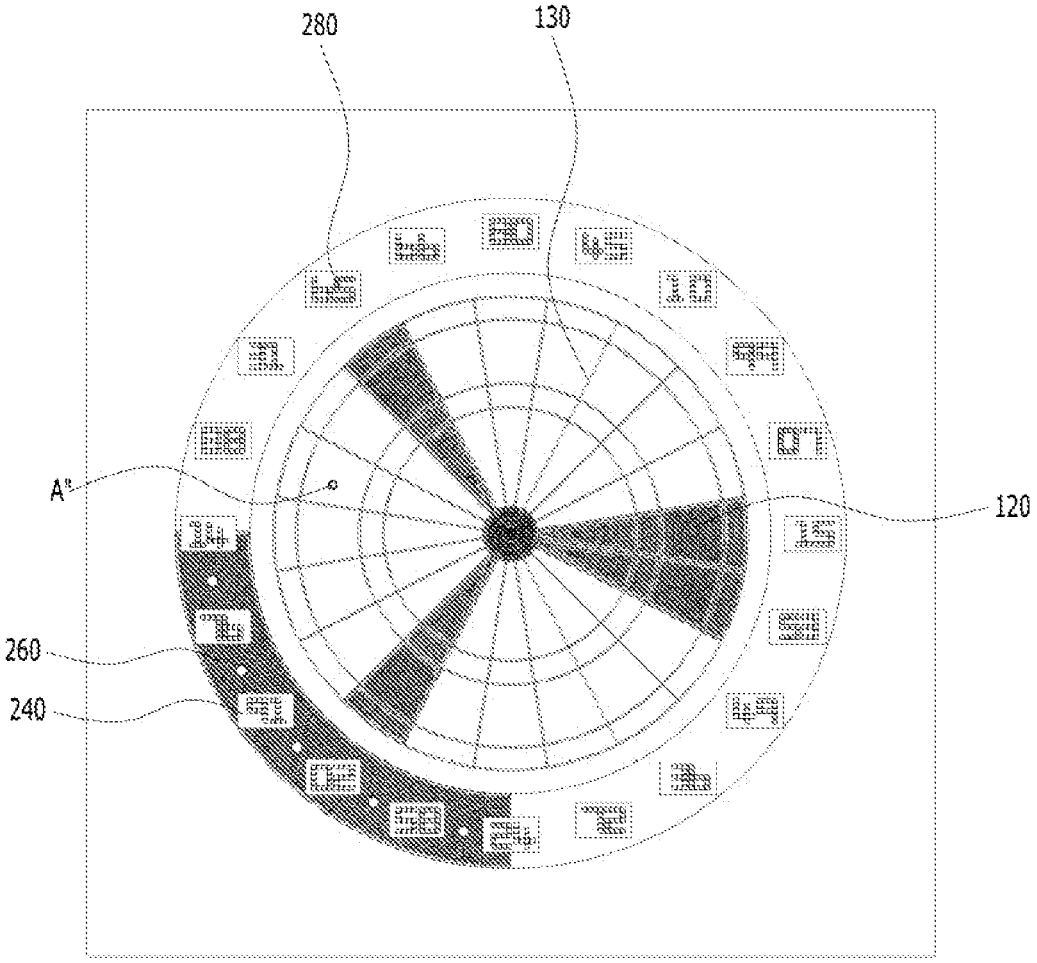
FIG. 13 is an exemplary view displaying an output of LED modules according to another embodiment of the present invention.

FIGS. 11 to 12 are exemplary views that locations of numbers are variably displayed as time passes within a one turn of an output of LED modules 280 according to an embodiment of the present invention, and FIG. 13 is an exemplary view displaying an output of LED modules according to another embodiment of the present invention.

As exemplary views of dartboards of FIGS. 11 to 12 and 13 illustrate states that some point area blocks 120 and others in an actual dartboard are not shown for the sake of convenience, the actual dartboard may be understood to be configured to have a form as in FIG. 3.

The output display of each LED module 280 by the controller 300, for example, is a number display corresponding to each target area and variably displayed as time passes within one turn by a preset control logic.

The 'turn' is a concept of time including an onetime throwing activity of the dart according to the output display of the LED module 280, and a state that the dart is hit on the target area and the dart hitting result is produced, and one turn may be understood as an onetime hitting of the dart (or a process for this) and one event may be composed of several number of turns depending on a type of the event.

The output display of each LED module 280 by the controller 300, for example, is controlled such that a location of a number is to be changed in a rotation direction as time passes. This change may be preferably accomplished at a fast speed to the extent that a user is not able to throw the dart by tracking the changed location.

The rotation direction may be understood as any one of a clockwise (CW) direction and a counter clockwise (CCW) direction, as illustrated in FIGS. 11 to 12.

That is, the controller 300 presets a time for location change and a displacement (a distance unit that a location is changed) of a number, and when a turn starts, as illustrated in FIGS. 11 to 12, a location of a number displaying the output of the LED module 280 for a time interval as much as is preset may be controlled to be changed to a displacement as large as is preset into a CW direction or a CCW direction.

The output display of each LED module 280 controlled by the controller 300, as another example, is controlled such that a location of a number is to be changed randomly as time passes. A random change like this, for example, may be accomplished by a random-number generation algorithm by a random number generator, and may be further used to reduce a gap in performance between one user having outstanding skill and another user having ordinary skill, relatively.

The output display of each LED module 280 according to an embodiment of the present invention may be controlled such that, to produce a hitting result according to an mutual connection of a location of a hitting spot that the dart hitting is made and a content of the output display of the LED module 280, a change speed of a location of a number is gradually decreased from a point of time of the dart hitting, and variable display of a location of a number is stopped as time goes by.

As the change speed of a location of a number is set to be gradually decreased, in a process that a user confirms whether the hitting is made on a target area the user wants, a dramatic effect of a point display along with a suspense may be added.

The output display of each LED module 280 according to another embodiment of the present invention may be controlled such that, at a point of time when preset time interval to stop has passed from a point of time of the dart hitting, variable display of a location of a number depending on a passage of time is stopped.

For example, the time to stop may be understood as a time taken from a point of time of the dart hitting to a point of time the variable display of a location of a number is stopped. Accordingly, when a preset time (e.g., a time to take for a display location of a number to rotate three times or five seconds) has passed from a point of time of the dart hitting, the variable display of a location of a number stops.

In an embodiment of the present invention, the output display of each LED module 280 may be set such that a change speed of a location of a number is decreased at a steady rate, or may be controlled for the variable display of a location of a number to be stopped immediately after the preset time to stop has passed without a speed change.

At this time, though it may be desirable to set a number displayed at a point of time of the dart hitting to be displayed same even when the variable display of a location of a number is stopped, in the case that the variable display of a location of a number is stopped after a preset time (e.g., five seconds) has passed, a different number other than the number displayed at a point of time of the dart hitting may be displayed.

The output display of each LED module 280 displays consistently one number as the variable display of a location of a number is stopped, and production of the dart hitting result to be described later is performed.

FIGS. 11 and 13 illustrate the output display of each LED module 280 at a point of time of the dart hitting, and FIG. 12 illustrates the output display of each LED module 280 at a state when the dart hits and variable display of a location of a number is stopped.

A dart hitting result acquired as the dart is hitting a specific target area, for example, is produced as a content of an output display of the LED module 280 corresponding to a location of the target area, the location being hit by the dart at a point of time of the dart hitting.

That is, as illustrated in FIG. 11, '14' that is a content of an output display of an LED module 280 corresponding to a location A of the target area being hit by the dart may be produced as a dart hitting result.

The content of an output display of the LED module 280, corresponding to a location of the target area hit by the dart at a point of time the dart hits as the dart is thrown by a user, may be preferable to be displayed at the same location even at a time when variable display of a location of a number is stopped as described earlier. Meanwhile, the controller 300 recognizes and stores the content (a corresponding number) of the output display of the LED module 280, corresponding to a location of the target area hit by the dart at a point of time the dart hits, and allows the content to be displayed at the same location at a time when variable display of a location of a number is stopped. In addition, the controller 300 allows the corresponding number to be produced as the dart hitting result and then to be displayed and stored.

As illustrated in FIG. 13, in the case that a number exceeding a range of 0 to 20 is displayed as the output display of the LED module 280, the content of the output display of the LED module 280 corresponding to a location A" of the target area being hit may be produced as a dart hitting result.

The dart hitting result, as another example, may be set by the controller 300 to be produced as the content of the output display of the LED module 280 corresponding to a location of the target area being hit by the dart, at a point of time that a variation of the output display of the LED module 280 is stopped.

In this case, as illustrated in FIG. 12, the controller 300 recognizes the content (e.g., '19') of the output display of the LED module 280 corresponding to a location A' of the target area hit by the dart at a point of time when variable display of a location of a number is stopped, other than the content of the output display of the LED module 280 corresponding to a location of the target area hit by the dart at a point of time of the dart hitting. In addition, the controller 300 allows the corresponding number to be produced as the dart hitting result and then to be displayed and stored. At this time, preferably, it is notified through a display means 500 to be described later that a number displayed on the location of the target area being hit at a point of time when variable display of a location of a number is stopped is to be produced as the dart hitting result.

The output display of the LED module controlled by the controller 300, as another example, may be set to be a display for an event generated by a preset control logic.

The event may be produced on the basis of a cumulative number of times of the dart hitting, time elapsed or not, user identification information, an event request command, etc., and may be arranged for users only participating in the game or all users in the course of the dart game, on startup of the game, or after the end of the game.

The event like this may consist of a provision of a mobile coupon and/or a giveaway, a change of a level of difficulty for acquiring a point to give a variety to the dart game underway or a provision of additional point, etc., and since a user identification including user information may be required for the event, a process of input of user information or user log-in through input means to be described later may be preceded.

The control logic may be set for the display for the event to be produced on the basis of any one of preset cumulative number of times of the dart hitting, randomly generated cumulative number of times of the dart hitting, passing of preset elapse time or not, user identification information, and an event request command.

The display for the event, as an example, as illustrated in FIGS. 11 to 12, may be displayed by positioning numbers from 1 to 20 in the LED modules 280, and, as another example, may be displayed with one of numbers from 0 to 99 in each LED module 280, provided that each LED module 280 may display a number different from each other or a number having at least one same number in other LED module 280, as illustrated in FIG. 13.

Depending on a success or a failure of the event condition on the basis of the display for the event according to an embodiment of the present invention, at least one of a display of an end of the event and a guide display of an event provision in a next turn is provided in the display means 500 to be described later.

The event condition, as one example, may be set such that three times of opportunities to throw the dart are given, and the consecutive hitting has to be accomplished in consecutive order on specific targets corresponding to year (e.g., two digit number), month, day, respectively, when the event is happened. At this time, a number displaying the output of the LED module 280 in next turn corresponding to each target area may be changed, and change method (e.g., rotation direction, or random change) or change speed of a number displaying the output of the LED module as time goes by may be differently controlled.

The event condition, as another example, may be set to hit a specific number only with one dart throwing, and an event like this should be made under the situation that a location of a number is managed to be changed within one turn as time goes by as described earlier.

The display of the end of the event corresponds to one of a display of achievement of the event (success) or a display of inadequate achievement of the event (failure), for example, any one of displays for provision of giveaway or point may be made in parallel or in consecutive order.

The electronic dart machine 10 according to an embodiment of the present invention includes the display means 500 displaying the dart hitting result produced by the controller 300.

The display means 500 may be selected from various publicly known display panels and may display various information such as current points the user acquired, cumulative points, number of violation of game rules, event information (e.g., announcement of performance of an event, event type and content description, notification of a success or a failure of the event) from the controller 300.

The electronic dart machine 10 according to an embodiment of the present invention is configured to further include input means 400 to input a control command. The control command being input by the input means 400 may be understood to be, for example, a game start command, an event request command, etc. Input of user identification information including User ID, log-in password may be accomplished by the input means 400 besides the control command.

The input means 400 may be configured to input at least one of the game start command, the user identification information, and the event request command.

Various publicly known input means 400 such as a keyboard, a mouse, a touch pad, Near Field Communication (NFC) using mobile terminal, etc. may be used, and the input means 400 may further include additional input module such as face, iris and/or fingerprint recognition for user identification.

The electronic dart machine 10, for example, may be configured to include a touch screen that the display means 500 and the input means 400 are coupled in a module shape.

The electronic dart machine 10 according to an embodiment of the present invention may be configured to further include a power supply part 800 supplying power to the LED display part 200 and the controller 300, wherein the power supply part 800 may be configured to supply power to the LED display part 200 through the controller 300. The power supply part 800 may be configured to include a power converting device such as a SMPS depending on a type of the controller 300, use of a DC LED, etc.

The electronic dart machine 10 according to an embodiment of the present invention may be configured to further include an infrared ray sensor (not shown), wherein the infrared ray sensor may determine valid dart hitting of the user by monitoring a location where the user throws the dart or by monitoring whether the dart is validly inserted into the front surface of the dartboard.

The electronic dart machine 10 according to an embodiment of the present invention may be configured to further include a camera (not shown), wherein the camera (not shown) observes and captures a posture of a user when the user throws the dart. Subsequently, the electronic dart machine 10 allows the user to see a filmed record or each user to enjoy a game seeing each other in an online game through a dart server 20 to be described later.

The electronic dart machine 10 according to an embodiment of the present invention may be connected to the dart server 20 through a communication network, wherein the dart server 20 may include cumulative points, points per a round, victory or defeat, skill level and/or personal information of each user. The dart server 20 may be configured to allow an online dart game to be possible between users being far apart by connecting several electronic dart machines 10 each other. In this regard, the dart server 20 may be understood as a publicly known server.

A user may connect to the dart server 20 by using a terminal 30 and perform user authentication, confirmation of points and personal information of the user, confirmation of other user's information that may be possible to be open to the public, comparison of skill levels between users, confirmation of an event result, receipt of giveaway for an event (e.g., mobile coupon), and so on. Meanwhile, the terminal 30 may be understood as a mobile device or a PC such as a smartphone, a PDA, a tablet PC, etc.

Figure 14:
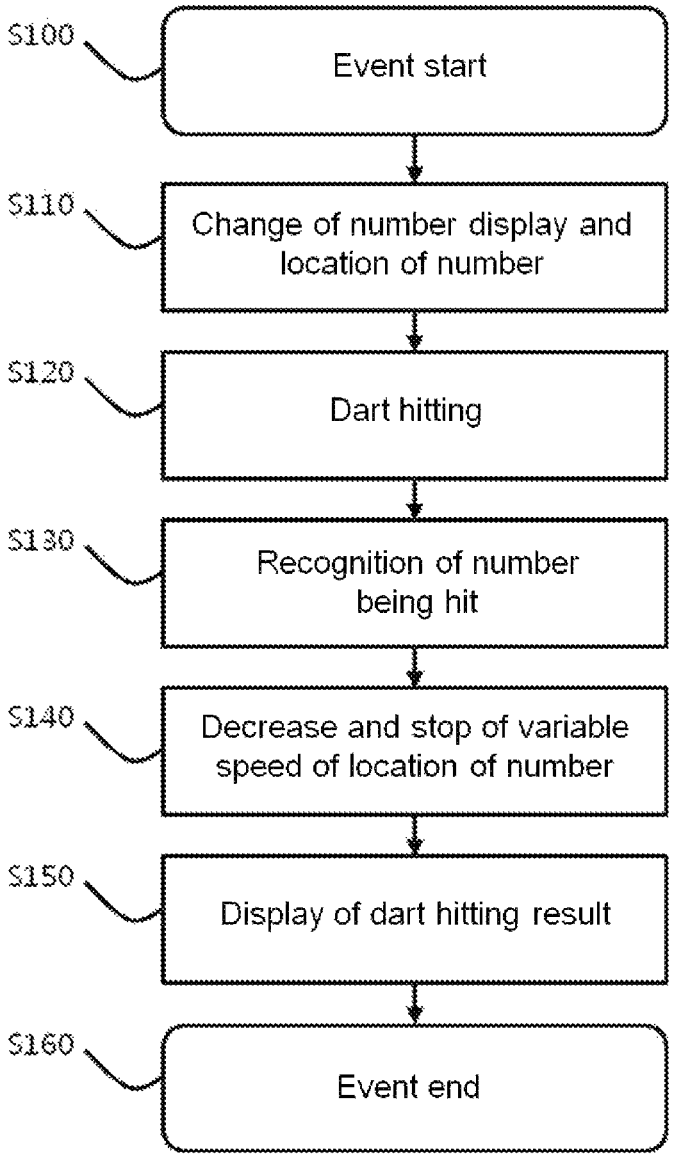
FIGS. 14 to 15 are flowcharts for a sequence of activities in an event according to an embodiment of the present invention.
Figure 15:
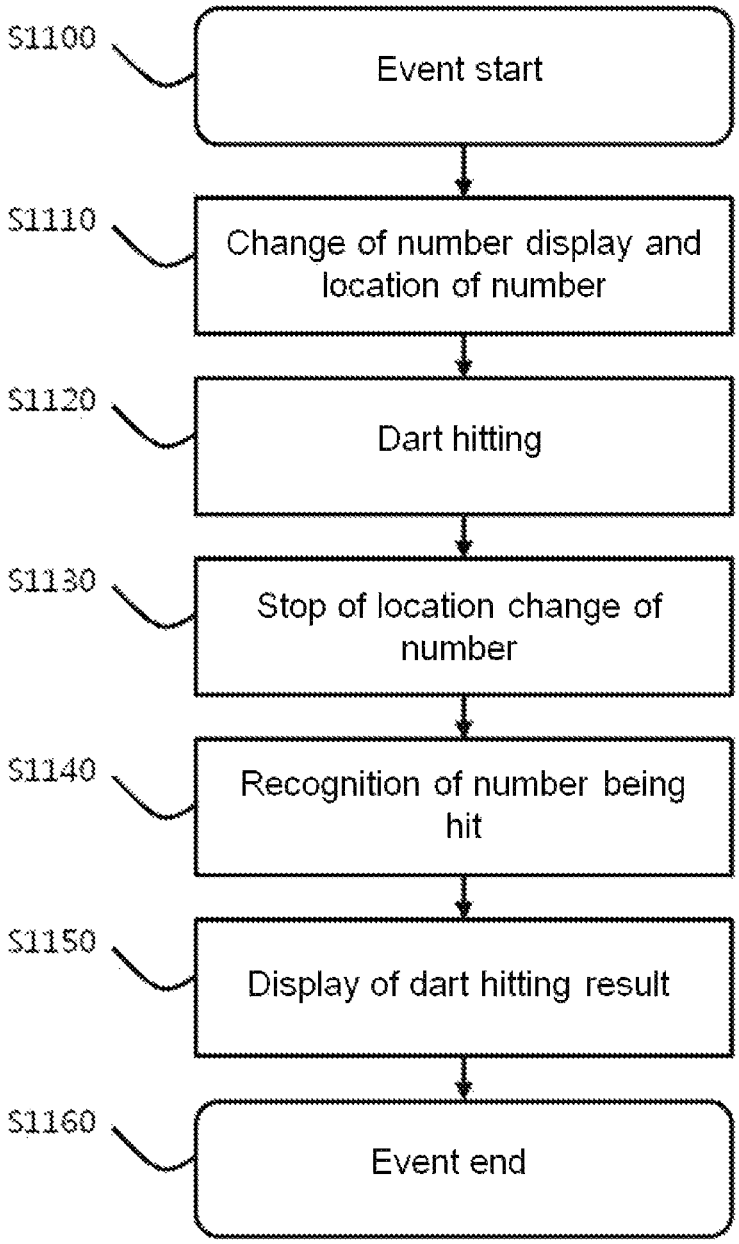

FIGS. 14 to 15 are flowcharts for a sequence of activities in an event according to an embodiment of the present invention, hereinafter, actions made in an event are described stage by stage in detail by focusing on accompanying drawings.

As illustrated in FIG. 14, an event according to an embodiment of the present invention starts with a "Start event" command (S100), and then each number in accordance with a preset event condition is displayed, and subsequently a location of each number is varied with a passage of time (S110). Provided a dart hitting is accomplished by throwing of a dart 110 by a user (S120), the controller 300 recognizes a number being hit (S130) and allows a variable velocity of a location of a number to be reduced gradually, whereby a variation of a location of a number stops (S140). The controller 300 displays the number recognized at step S130 as a dart hitting result (S150), and by displaying an "End" mark, ends the event (S160).

As illustrated in FIG. 15, an event according to another embodiment of the present invention starts with a "Start event" command (S1100), and then each number in accordance with a preset event condition is displayed, and subsequently a location of each number is varied with a passage of time (S1110). Provided a dart hitting is accomplished by throwing of a dart 110 by a user (S1120), the controller 300 recognizes a dart hitting and controls to stop a variation of a location of a number (S1130). At this time, it may be possible for the event to be set to stop a variation of a location of a number by allowing a variable velocity of a location of a number to be reduced gradually. The controller 300 recognizes a content of the output display of the LED module 280 (a number) corresponding to a target area being hit at a state that a variation is stopped as a number being hit (S1140), and displays this as a dart hitting result (S1150), and by displaying "End" mark, ends the event (S1160).

Figure 16:
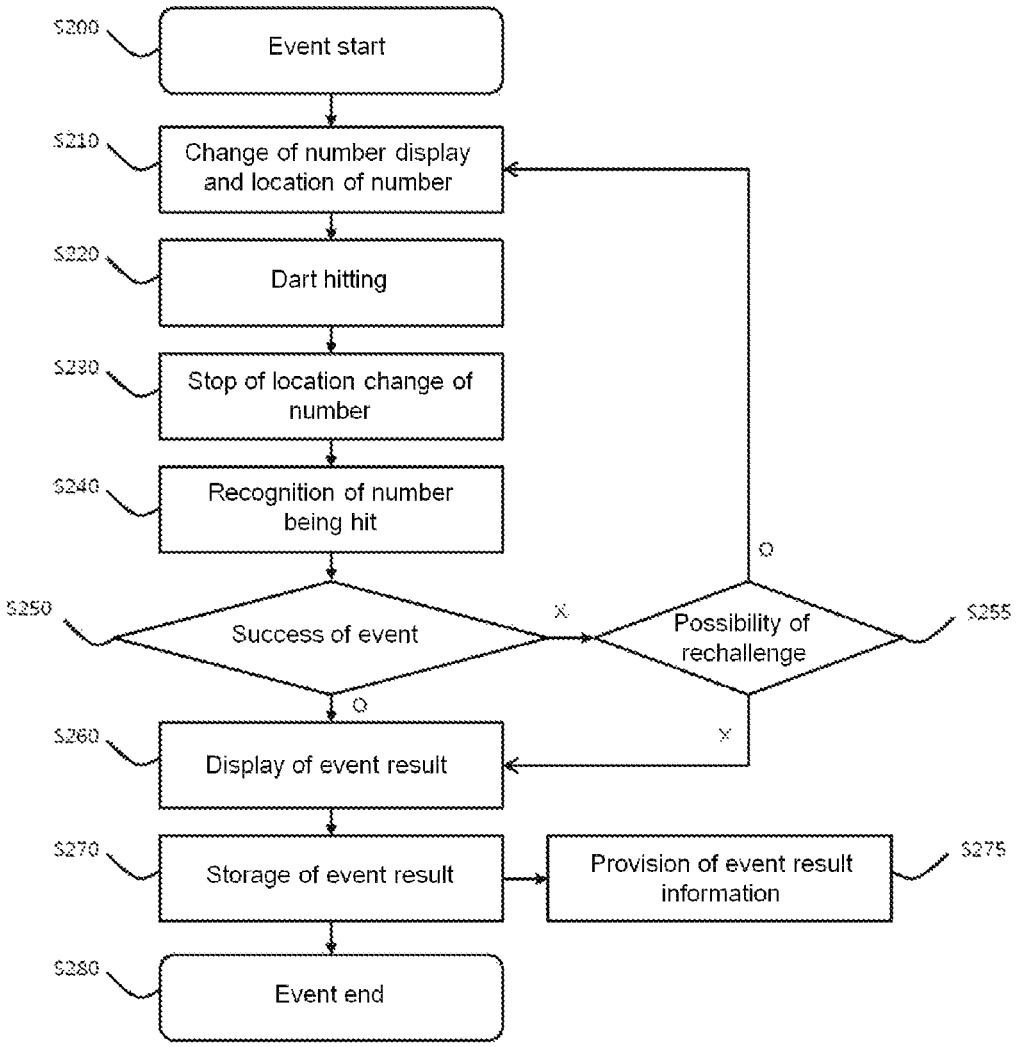
FIGS. 16 to 17 are flowcharts for a sequence of activities in an event according to another embodiment of the present invention.
Figure 17:
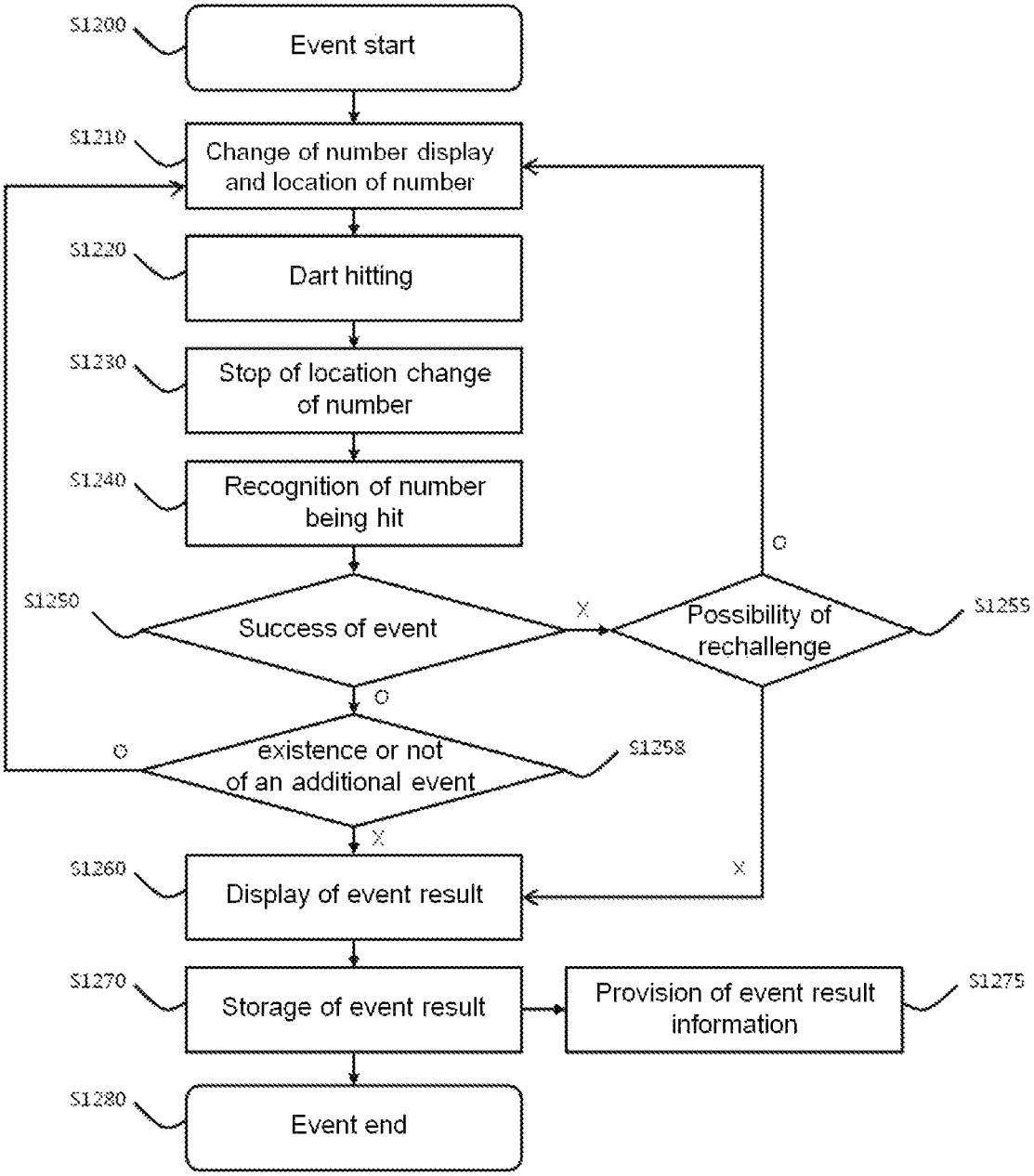

FIGS. 16 to 17 are flowcharts for a sequence of activities in an event according to another embodiment of the present invention.

As illustrated in FIG. 16, an event according to another embodiment of the present invention starts with a "Start event" command (S200), and then a number in accordance with a preset event condition is displayed, and subsequently a location of a number is varied with a passage of time (S210). Provided a dart hitting is accomplished by throwing of a dart 110 by a user (S220), the controller 300 recognizes a dart hitting and controls to stop a variation of a location of a number (S230). The controller 300 recognizes a content of the output display of the LED module 280 (a number) corresponding to a target area being hit at a state that a variation is stopped as a number being hit (S240), and allows a next logic to be provided by determining whether the event condition is met or not (a success or a failure of meeting the event condition) (S250).

Provided the event is a success, the controller 300 displays the number recognized at step S240 as a dart hitting result and an event result (S260), and after saving the event result (S270), ends the event (S280). The event result is provided to a portable terminal of a user or the internet for the user to confirm the result (S275).

Provided the event is a failure, it is determined whether rechallenge is possible or not (S255). In the case that a rechallenge is possible, step S210 proceeds again, and the user earns an opportunity to throw the dart, but, in the case rechallenge is impossible, step S260 proceeds, and an event result according to an event failure is displayed (S260), the event result is stored (S270), and the event ends (S280). The "whether rechallenge is possible or not" may be preset by the controller 300, and an allowed number of rechallenge may be designated on startup of an event or in the course of the event on a request from the user. The "whether rechallenge is possible or not" and an "existence or nonexistence of an additional event' to be described later may be displayed by the display means 500.

As illustrated in FIG. 17, an event according to another embodiment of the present invention starts with a "Start event" command (S1200), and then a number in accordance with a preset event condition is displayed, and subsequently a location of a number is varied with a passage of time (S1210). Provided a dart hitting is accomplished by throwing of a dart 110 by a user (S1220), the controller 300 recognizes a dart hitting and controls to stop a variation of a location of a number (S1230). The controller 300 recognizes a content of the output display of the LED module 280 (a number) corresponding to a target area being hit at a state that a variation is stopped as a number being hit (S1240), and allows a next logic to be provided by determining whether the event condition is met or not (a success or a failure of meeting the event condition) (S1250).

Provided the event is a success, the controller 300 determines an existence or nonexistence of an additional event (S1258). In the case of an existence of an additional event, as step S1210 proceeds again, the user becomes to throw the dart, but, in the case of a nonexistence of an additional event, an event result is displayed by the controller 300 (S1260), and after the event result is stored (S1270), the event ends (S1280).

The event result is provided to a portable terminal of a user or the internet for the user to confirm the result (S1275).

The additional event may be understood the case of existence of at least two event conditions similarly to the dart throwing condition of three times described earlier, and in the case of an existence of an additional event, guidance for a provision of an event for a next turn is displayed by the display means 500.

Provided the event is a failure, it is determined whether rechallenge is possible or not (S1255). In the case that rechallenge is possible, step S1210 proceeds again, and the user earns an opportunity to throw the dart, but, in the case rechallenge is impossible, step S1260 proceeds, and an event result according to an event failure is displayed (S1260), the event result is stored (S1270), and the event ends (S1280).

Although the present invention has been described centering around a preferred embodiment with reference to the accompanying drawings, those skilled in the art will clearly appreciate that various self-evident modifications, additions and substitutions are possible, without departing from the category of the present invention. Accordingly, the category of the present invention should be interpreted by the attached claims described to include those examples of modifications.

The invention claimed is:

1. An electronic dart machine, comprising:

a dart target part having a board shape divided into a plurality of target areas and including a sensor means detecting a location of a target area hit by a dart;

an LED display part including a plurality of LED modules, each LED module being positioned at a location corresponding to an outermost part of each target area along a periphery of the dart target part; and a controller controlling an output display of each LED module by a preset control logic, recognizing the location of a target area through the sensor means, the location being hit by the dart, and producing a dart hitting result by linking a content of the output display of the LED module with the location of the target area, the location being hit by the dart, wherein the dart target part has a circular-shaped front surface part and the LED display part has a ring-shaped front surface part surrounding the periphery of the dart target part, and wherein the LED display part includes:

a display board formed in a ring shape, with the LED modules being attached thereto; and a cover board formed in a ring shape corresponding to the shape of the display board, installed in a front surface side of the display board, having protection windows each formed at a location corresponding to each LED module, and having a plurality of tip holes at an area other than the protection windows so as to allow a dart tip to be inserted therethrough.

2. The electronic dart machine of claim 1, wherein, at outermost locations of the LED modules of the display board, a plurality of lighting LEDs is positioned in a ring shape, and on a dartboard front surface frame having a front surface part surrounding the periphery of the cover board, a light projection part that allows light projected from the lighting LEDs to pass through is provided.

3. The electronic dart machine of claim 1, further comprising:

display means displaying the dart hitting result produced by the controller; and input means inputting at least one of a game start command, user identification information, and an event request command.

4. The electronic dart machine of claim 1, wherein the output display of each LED module is a number display corresponding to each target area and variably displayed by the preset control logic.

5. The electronic dart machine of claim 1, wherein the output display of each LED module is a display for an event generated by the preset control logic.

6. The electronic dart machine of claim 5, wherein the preset control logic is set such that the display for the event to be generated on the basis of any one of preset cumulative number of times of the dart hitting, randomly generated cumulative number of times of the dart hitting, passing of preset elapse time or not, passing of randomly generated elapse time or not, user identification information, and an event request command.

7. The electronic dart machine of claim 5, wherein, depending on a success or a failure of meeting an event condition on the basis of the display for the event, the output display of each LED module in subsequent order is controlled to be variable.

8. The electronic dart machine of claim 7, wherein the event condition is a success or a failure of a dart hitting a specific target area, and on the basis of a success or a failure of meeting the event condition, a number displayed on each LED module in a subsequent order, corresponding to each target area, is controlled to become larger or smaller.

9. The electronic dart machine of claim 1, further comprising:

display means displaying the dart hitting result produced by the controller; and input means inputting a control command, wherein the output display of each LED module is a number display corresponding to each target area and variably displayed as time goes by within a-one turn by a preset control logic.

10. The electronic dart machine of claim 9, wherein the output display of each LED module is controlled such that locations of the numbers of the LED modules are to be changed in a rotation direction as time passes.

11. The electronic dart machine of claim 9, wherein the output display of each LED module is controlled such that locations of the numbers of the LED modules are to be changed randomly as time passes.

12. The electronic dart machine of claim 9, wherein the output display of each LED module is controlled such that a change speed of locations of the numbers of the LED modules is gradually decreased from a point of time of the dart hitting, and variable display of the locations of the numbers is stopped as time goes by.

13. The electronic dart machine of claim 9, wherein the output display of each LED module is controlled such that, at a point of time when a preset time interval to stop has passed from a point of time of the dart hitting, variable display of locations of the numbers of the LED modules depending on a passage of time is stopped.

14. The electronic dart machine of claim 9, wherein the dart hitting result is produced as the content of the output display of an LED module corresponding to the location of the target area hit by the dart, the location being hit by the dart at a point of time when variable display of locations of the numbers of the LED modules is stopped.

15. The electronic dart machine of claim 9, wherein the dart hitting result is produced as the content of the output display of an LED module corresponding to the location of the target area hit by the dart at a point of time of the dart hitting.

16. The electronic dart machine of claim 9, wherein the output display of each LED module is a display for an event generated by the preset control logic, the preset control logic is set such that the display for the event is produced on the basis of any one of preset cumulative number of times of the dart hitting, randomly generated cumulative number of times of the dart hitting, passing of preset elapse time or not, passing of randomly generated elapse time or not, user identification information, and an event request command, and, depending on a success or a failure of the event condition on the basis of the display for the event, at least one of a display of an end of the event and a guide display of an event provision in a next turn is provided in the display means.

* * * * *